United States Patent [19]

Cygnor

[11] Patent Number: 4,948,344

[45] Date of Patent: Aug. 14, 1990

[54] CONTROLLED VORTEX REGENERATIVE PUMP

[75] Inventor: John E. Cygnor, Rockford, Ill.

[73] Assignee: Sundstrand Corporation, Rockford, Ill.

[21] Appl. No.: 422,424

[22] Filed: Oct. 17, 1989

[51] Int. Cl.[5] ..... F04B 49/00

[52] U.S. Cl. ..... 417/279; 415/55.1; 415/55.5

[58] Field of Search ..... 415/55.1, 55.5, 55.6, 415/55.7, 127, 146, 55.3; 417/368, 279

[56] References Cited

U.S. PATENT DOCUMENTS

| | | | |
|---|---|---|---|
| 1,920,484 | 8/1933 | Siemen et al. | 415/55.1 |
| 1,976,896 | 10/1934 | Siemen et al. | 415/224 |
| 2,045,851 | 6/1936 | Hamilton | 415/55.7 |
| 2,696,789 | 12/1954 | Fabig | 415/55.1 |
| 3,558,236 | 9/1968 | Bylsma | 415/55.1 |
| 3,936,240 | 2/1976 | Dochterman | 417/368 |
| 4,325,672 | 4/1982 | Sixsmith et al. | 415/55.3 |
| 4,334,821 | 6/1982 | Sixsmith et al. | 415/55.5 |
| 4,408,952 | 10/1983 | Schweinfurter | 415/55.6 |

*Primary Examiner*—Edward K. Look
*Assistant Examiner*—F. H. Stephan
*Attorney, Agent, or Firm*—Antonelli, Terry, Stout & Kraus

[57] ABSTRACT

A regenerative pump which has a controlled output by having movable lateral channel arcuate slots (36, 38) in channel plates (26) which are on opposite sides of a bladed rotor (18). The channel plates (26) are mounted for sliding movement to reduce the effective vortex channel length in a range from about 325° to about 40°. This will result in a proportional reduction of pump pressure rise and input power requirements. The position of the channel plates may be varied by a servo system that responds to a desired system output performance such as pressure rise or flow delivery rate.

15 Claims, 3 Drawing Sheets

CONTROLLED VORTEX REGENERATIVE PUMP

This invention relates to a controlled vortex regenerative pump which has lateral vortex forming channels that are adjustable as to length via a servo system that responds to a desired system output performance.

Background Art:

Prior art lateral channel regenerative pumps have a housing with a shaft mounted in a sealed manner for rotation and a rotor secured to the shaft. A flow channel which starts from an inlet port in the housing leads to a discharge port via a lateral channel formed in the housing and corresponding rotor blade compartments. It is customary for the rotor and flow channels to be coextensive by having the same length and a constant cross section for the lateral channels except for the inlet and discharge regions.

Regenerative centrifugal pumps have the desirable characteristic of generating high pressure within a small physical size. It is a centrifugal device that can compete with positive displacement pumps in the high pressure low flow performance range. Regenerative pumps generate pressure by a repetitive vortex action between a rotating radially bladed disc and a matching circumferential channel in the housing. The channel is interrupted as by a stripper formation for a distance of at least one rotor blade spacing to provide an inlet to discharge seal. The pressure rise generated is proportional to the length of the circumferential channel in the housing.

Another operating characteristic of regenerative pumps is that input power and pressure rise increase significantly at reduced delivery flow rates because the vortex action is more intense due to the increased fluid residence time within the pump. For some applications, such as hydraulic systems, this characteristic is undesirable because of the increased heat load imposed on the system. To be able to supply the advantages of simplicity and inherent durability that regenerative pumps offer relative to positive displacement pumps, a simple means of reducing the input power and pressure rise characteristics at reduced flow rates is desired.

Disclosure of Invention:

It is an object of the present invention to provide a novel control vortex regenerative pump where input power is reduced at reduced flow delivery rates.

Another object is to provide a novel control vortex regenerative pump which provides a variable effective length for the lateral channel while maintaining the number and size of rotor blade compartments constant.

A further object is to provide a novel channel plate structure that has a lateral channel which can be positionally adjusted relative to both the rotor blade compartment path and the housing to regulate the effective length of the circumferential vortex forming channel. Limited displacement of the channel plates can reduce the effective channel length by a factor of up to eight. This will result in a proportional reduction of pump pressure rise and input power requirement.

A yet further object is to provide a novel controlled vortex regenerative vane pump whose output is varied by a servo system that responds to the desired system output performance such as pressure rise or flow delivery rate.

These and other objects of the invention will become more fully apparent from the claims and from the description as it proceeds in connection with the appended drawings.

Figure 1:
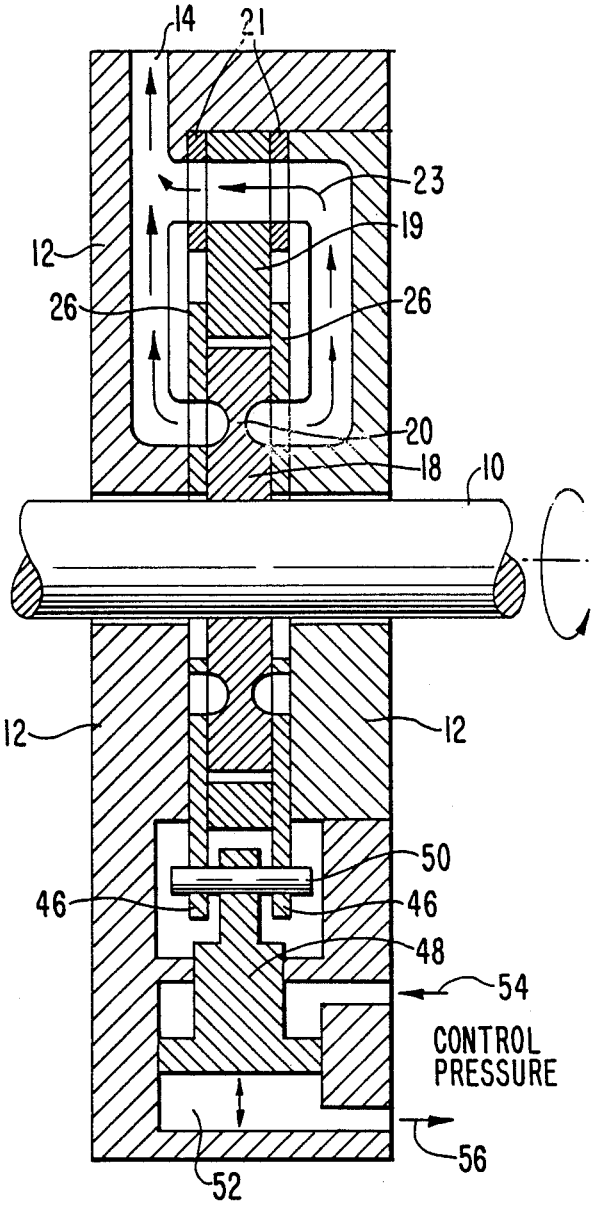
FIG. 1 is a longitudinal section of a lateral channel regenerative rotary pump which embodies the present invention.
Figure 2:
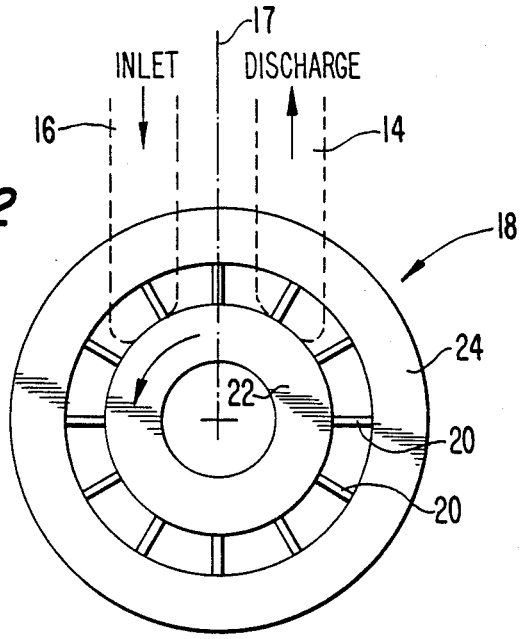
FIG. 2 is a face view of the pump rotor showing the inlet and discharge ports of the housing.

Best Mode For Carrying Out The Invention:

The regenerative pump of the present invention as illustrated in FIG. 1 has a shaft 10 mounted for rotation in a two piece housing 12 having a discharge port 14. FIG. 2 diagrammatically shows both the inlet port 16 and the discharge port 14 as being parallel and equidistant from a diametral plane 17 that extends upwardly between the ports. Rotor 18 has a number of conventional blades 20 that are supported between an inner hub 22 and outer ring 24 as is conventional in this type of vortex generation pump. Blade compartments are formed between adjacent blades 20 and form a circular fluid transfer path between inlet port 16 and discharge port 14.

Figure 3:
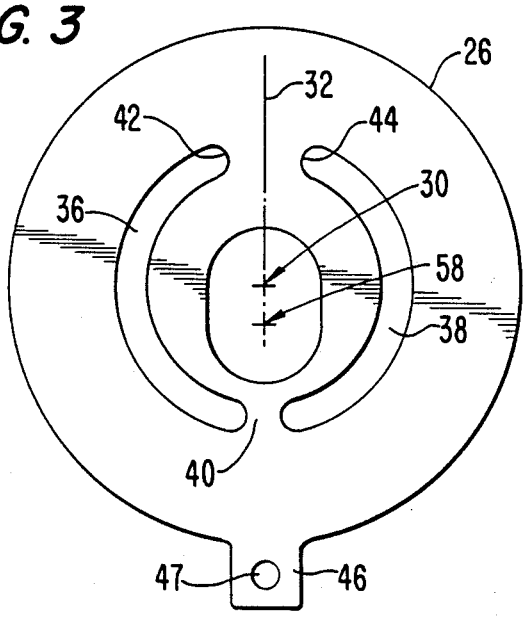
FIG. 3 is a face view of one of the two identical channel plates.

In the illustrated embodiment, a pair of channel plates 26 are non-rotatably mounted on opposite sides of the rotor. In FIG. 3, one channel plate 26 that may be used is shown to have a thru-slot which is in the form of two arcuately shaped openings 36, 38 having a center 30 to thereby provide a pair of laterally positioned vortex forming channels symmetrically disposed on opposite sides on the rotor 18. The central portion of each channel plate has an oblong opening with a major axis 32 that is aligned with axis 17 shown in FIG. 2.

Surrounding the rotor 18 is an annular ring 19 which provides support for separator plates 21. Separator plates 21 are horseshoe shaped in that they are open at the bottom as viewed in FIG. 1 to provide space for tabs 46 on the channel plates 26 as will be discussed below.

At the upper portions of annular ring 19 and the two separator plates 21, ears with aligned through apertures are provided to transfer fluid as indicated by arrows 23 to the discharge port 14.

FIG. 3 shows a preferred construction of the channel plates 26 wherein two arcuate slots 36, 38 are separated by a lower bridge portion 40 that is diametrically opposite the ends 42, 44 of the arcuate slots adjacent the discharge and inlet ports 14, 16. The bridge portion between slot ends 42, 44 serves as a stripper formation or seal for the pump. The bridge portion 40 at the lower end of the rotor serves to prevent undesired flow between high and lower pressure blade compartments when the pump is operating with a minimum vortex channel as will be discussed below in connection with the description of FIG. 5.

Each channel plate 26 is provided with a tab 46 which extends along slot axis 32 to be connected via aperture 46 to an actuator piston 48 as via bridging pin 50 all as shown in FIG. 1. Piston 48 is illustrated at its lowermost position in chamber 52 by reason of control pressure differential applied as indicated by arrows 54, 56. This corresponds to a position where slot center 30 is coincident with the axis of shaft 10. By reversing the direction of the applied fluid pressure indicated by arrows 54, 56, piston 48 moves upwardly and causes the channel plates 26 to move by a transverse sliding motion between a wall of housing 12 and a face of rotor 18. The direction of this movement is parallel to the slot major axis 32 as illustrated in FIG. 3. The control pressure may be produced in response to monitoring system pressure or flow discharge rate detected at discharge port 14 or at an appropriate downstream position to thus be dependent on system output performance.

Figure 4:
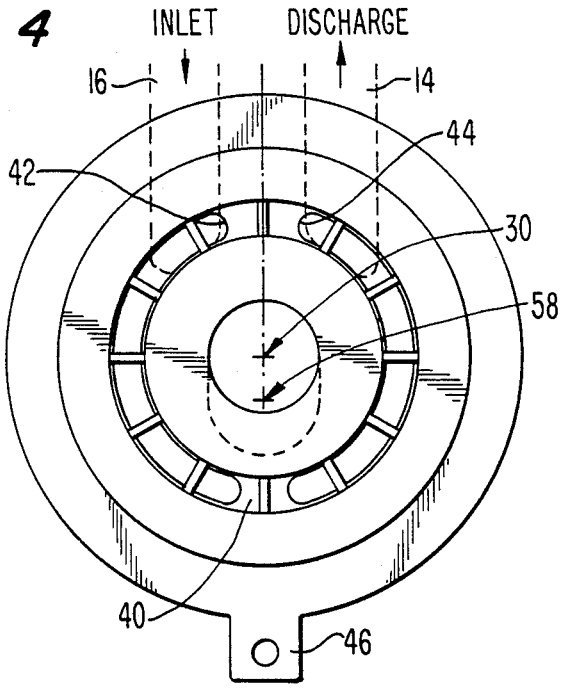
FIG. 4 is a view showing a channel plate and the rotor together in a relative position to give maximum flow.
Figure 5:
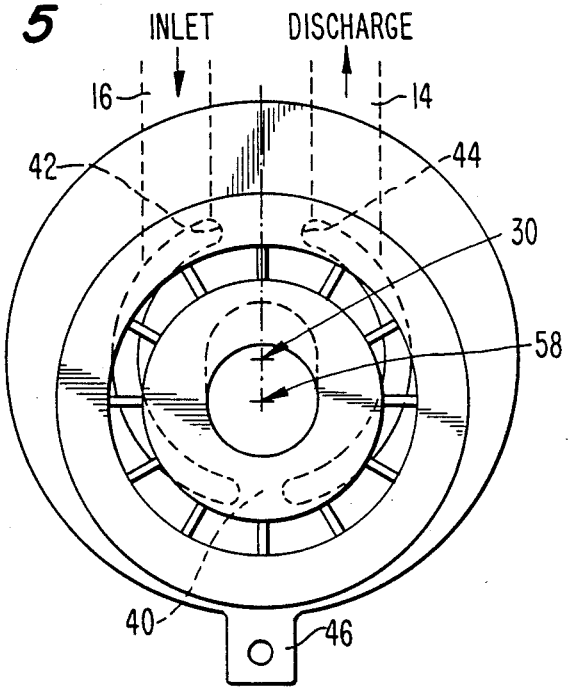
FIG. 5 is a view similar to FIG. 4 showing the channel plates at a minimum flow position.

With reference to FIGS. 4 and 5, one of the slidedly mounted control channel plates 26 is shown superimposed on the rotor 18. In FIG. 4, the center 30 is in alignment with the axis of shaft 10 to give the pump maximum capacity. In FIG. 5, the center 58 is aligned with the axis of shaft 10 to give minimum pumping capacity and a reduced power requirement.

In FIG. 4, the vortex forming slots 36, 38 in the channel plate 28 are in alignment with the blade compartments for the entire circumferential distance from the inlet port 16 to the discharge port 14 to give maximum pumping capacity. This position gives a maximum effective vortex channel circumferential length which in the illustrated embodiment is about 325° to produce 2500 psid.

In FIG. 5, the channel plate 26 is shown at a position displaced upwardly to the discharge and inlet ports 14, 16 along the direction of the central opening major axis 32. This displacement may be slightly greater than the radial distance between the walls of arcuate slots 36, 38 whereby the upper ends 42, 44 are no longer in registration with the compartments between the blades 20 at the inlet port 16 and at the outlet port 14.

A similar misalignment occurs with respect to the ends of the slots at the bridge portion 40. The bridge portion 40 serves to prevent reverse fluid flow from a blade compartment that has a high pressure to a blade compartment which has a lower pressure.

The lateral channels formed by channel plate arcuate slots 36, 38 that is in active registration with rotor blade compartments over only a portion of the circumferential length of the channel plate arcuate slots 36, 38, may give a minimum effective vortex channel length of about 40° to produce about 300 psid. Full movement of the channel plates 26 will reduce the effective length of the slots by a factor of about eight. This will result in a proportional reduction of pump pressure rise and input power required to operate the pump.

The position of the channel plates 26 may be varied to any of an infinite number of intermediate positions by any suitable means. Disclosed is a servo system that responds to a desired system output performance which, as mentioned above, may be proportional to pressure rise or flow delivery rate.

It is apparent that many changes may be made without departing from the spirit of the invention. All changes which fall within the scope of the appended claims are intended to be covered thereby.

I claim:

1. A lateral channel regenerative pump comprising:

a housing;

a shaft extending into said housing having an axis;

a rotor secured to said shaft including a ring of rotor blade compartments;

intake and discharge ports disposed in an adjacent relationship on opposite sides of a diametral plane that includes said shaft axis;

a pair of substantially identical channel plates each having a central slot shaped opening having a major axis lying in said diametral plane and a pair of arcuate slotted openings on opposite sides of said major axis, one end of one arcuate opening being at said inlet port and one end of the other arcuate opening being at said discharge port;

said channel plates being positioned on said shaft and mounted for sliding movement relative to the housing in a direction parallel to the major axis of said central slot shaped opening;

the arcuate slotted openings being aligned with and providing lateral channels on opposite sides of said rotor so that when the central slot shaped opening is at one position on said rotor shaft the arcuate slotted openings are aligned with the path of said blade compartments to provide maximum pump capacity and when the central slot shaped opening is at a different position, the arcuate slotted openings are eccentric relative to the rotor blade compartments to provide a lateral channel of reduced effectiveness and thereby to reduce the pump capacity and input power requirements.

2. The pump as defined in claim 1 further having means for varying the radial position of the channel plates relative to the rotor including a servo system and the position of the channel plates is adjusted in response to system output performance.

3. The pump as defined in claim 2 wherein the channel plate position varying means comprises:

a hydraulic cylinder fixed to the housing;

a piston in said cylinder and connected to said channel plates for effecting movement of said plates in a direction parallel to said slot shaped opening major axis; and means for regulating the pressure applied to the cylinder in response to discharge port pressure or flow delivery rate.

4. The pump as defined in claim 2 wherein the arcuate slotted openings have a substantially uniform width in the radial direction and the plate position varying means is capable of a radial displacement in a direction of the inlet and discharge ports which is greater than the radial width of said arcuate slotted openings.

5. The pump as defined in claim 4 wherein the arcuate slotted openings in each channel plate have substantially equal length, are symmetrically located relative to the slot shaped opening major axis and are separated at diametrically opposite end portions by solid material with one solid material portion being between the housing inlet and discharge ports as a stripper formation which seals the channel formed by said arcuate slotted openings.

6. The pump as defined in claim 1 wherein the housing inlet and discharge ports are circumferentially distanced by at least one circumferential length of a rotor blade compartment and said diametral plane is midway between said ports.

7. A controlled vortex regenerative pump including:

a rotor having blades forming blade compartments which is mounted for rotation in a pump housing having two channel plates, one plate being on each side of said rotor, with vortex forming channels in each plate extending from an inlet port and from a discharge port and having two diametrically opposite bridging portions;

one of said bridging portions serving as a seal between inlet and discharge ports for said pump; and means for sliding said channel plates in a direction perpendicular to a rotational axis of said rotor to misalign the vortex forming channels with respect to the path of the rotor blade compartments thereby to reduce pump pressure rise and input power required.

8. The pump as defined in claim 7 wherein the channel plate sliding means comprises a servo system that responds to a desired system output performance.

9. The pump as defined in claim 8 wherein the servo system includes:

a hydraulic cylinder;

a piston in said cylinder and connected to said channel plates; and means for regulating pressure applied to the cylinder in response to discharge port pressure or flow delivery rate.

10. A controlled vortex regenerative pump including:

a housing having inlet and discharge ports;

a rotor having blades forming a constant number of blade compartments which is mounted for rotation in said housing so that the blade compartments traverse a path from the inlet port to the discharge port, said path being between lateral vortex forming channels that are on opposite sides of said rotor; and means to reduce pump pressure rise and input power required at reduced flow delivery rates by varying the effective lengths of both lateral vortex forming channels with respect to the path of the rotor blade compartments.

11. The pump as defined in claim 10 wherein the lateral vortex forming channels have a first discontinuous portion along the path of the blade compartments at a circumferential location remote from either of said inlet and discharge ports and said channel length varying means is effective to selectively increase the circumferential length of said discontinuous portion to reduce said pump pressure rise and input power required.

12. The pump as defined in claim 11 wherein said channel length varying means includes a cylinder and piston mounted for movement therein along an axis that is perpendicular to a rotational axis of said shaft and means for applying a control pressure to said cylinder for movement of said piston.

13. The pump as defined in claim 12 wherein the lateral channels each comprise a pair of arcuate slots in separate channel plates that are positioned on opposite sides of said rotor and the piston is connected to said channel plates at a position axially aligned with said first discontinuous portion.

14. The pump as defined in claim 13 wherein the rotor is mounted on a shaft and said channel plates have oblong slotted central portions which fit over said shaft to allow movement of the channel plates transverse to the axis of said shaft.

15. The pump as defined in claim 10 wherein said channel length varying means includes a cylinder and piston mounted for movement therein along an axis that is perpendicular to a rotational axis of said shaft and means for applying a control pressure to said cylinder for movement of said piston.

* * * * *